United States Patent [19]

Meinerding

[11] Patent Number: 4,825,918

[45] Date of Patent: May 2, 1989

[54] WOOD SPLITTING LEVERAGE SLEDGE

[76] Inventor: Wesley C. Meinerding, 1019 Knollwood Rd., N.W., Canton, Ohio 44708

[21] Appl. No.: 207,113

[22] Filed: Jun. 14, 1988

Related U.S. Application Data

[63] Continuation-in-part of Ser. No. 168,175, Mar. 15, 1988, abandoned.

[51] Int. Cl.[4] ..... B27L 7/00

[52] U.S. Cl. ..... 144/193 C; 7/145; 144/193 D; 144/366; 254/25; 254/104

[58] Field of Search ..... 254/25, 104; 7/144, 7/145; 144/34 B, 193 R, 193 C, 193 D, 193 E, 366

[56] References Cited

U.S. PATENT DOCUMENTS

| | | | |
|---|---|---|---|
| 1,662,538 | 3/1928 | Richmond . | |
| 2,212,080 | 8/1940 | Seward | 254/104 |
| 2,525,226 | 10/1950 | Lawellin | 254/25 |
| 2,934,984 | 5/1960 | Woodman . | |
| 3,050,095 | 8/1962 | Prather . | |
| 3,219,316 | 11/1965 | Fried | 7/145 |
| 3,604,028 | 9/1971 | Wardell | 7/8.1 |
| 4,280,540 | 7/1981 | Meacham | 144/193 C |
| 4,294,298 | 10/1981 | Otte, Jr. | 144/193 C |
| 4,308,903 | 1/1982 | Alloway | 144/193 C |
| 4,362,194 | 12/1982 | Lawson | 144/193 R |
| 4,451,024 | 5/1984 | Shepherd | 144/143 D |

FOREIGN PATENT DOCUMENTS 931 of 1894 United Kingdom ..... 254/25

OTHER PUBLICATIONS

Frontiersman's Multi-Purpose Tool advertisement.

*Primary Examiner*—W. Donald Bray
*Attorney, Agent, or Firm*—Donovan Lee Favre

[57] ABSTRACT

The present disclosure is directed to a log splitting sledge. The sledge has a cutting blade projecting from a lower face of the head of the sledge. One face of the blade is integral with a side face of the head and extends at an angle of about 12 degrees of the handle. The angle is a result of either a bend in the handle or the handle being mounted in the head at a non 90 degree angle. The sledge is first used to drive one or more wedges in a log, partially splitting the log. The head of the sledge is then forced down into the partially split log, the log standing on end and the handle protruding upwardly. Then the sledge handle is moved through an arc having the blade edge as a pivot line to complete the splitting of the log. If any slivers are holding the split portions together, the sledge can be then used as a vertical axe with the front cutting edge slicing through the slivers.

18 Claims, 3 Drawing Sheets

WOOD SPLITTING LEVERAGE SLEDGE

CROSS REFERENCE TO RELATED APPLICATION

This application is a continuation-in-part of my application Ser. No. 168,175 filed Mar. 15, 1988, entitled WOOD SPLITTING LEVERAGE SLEDGE, now abandoned.

BACKGROUND OF THE INVENTION

Historically logs have been split for firewood using an axe or by driving a wedge into the log with a sledge. Hand implements often only started the split at the initial impact and the completion of the split was very difficult. To overcome this problem, complex machinery was developed which provided the forces that hand implements were incapable of providing. An exception to the direction that the prior art took is shown in U.S. Pat. No. 4,294,298 of Otte (1981). That Patent describes using a spring to reduce the impact of a log splitting blade. The prior art also teaches combining a pry bar with a hatchet, but that device is not designed to split logs nor is such a use suggested by advertisements for the hatchet-pry bar combination.

BRIEF SUMMARY OF THE INVENTION

This invention is directed to a sledge having a cutting blade extending downward from the bottom face of the head to form a vertical axe. The blade cuts slivers which hold a partially split log together and also acts as a force arm of a lever which allows the handle of the sledge to act as a lever in prying a partially split log apart. By slivers is meant the pieces of wood which extend from one side of a partially split log to the other side of a partially split log and tend to hold the partially split sections together. The blade can be integral with the sledge or can be a detachable attachment to the sledge. A sledgehammer is otherwise known as a sledge.

The sledge is initially used to drive a wedge into a log to form an initial split. The split is then completed by pushing the sledgehammer head into the split and using the handle of the sledge as a lever to pry the log apart, the end of the blade functions as a short arm of a lever extending from the sledge head which acts as a fulcrum. The force of the lever is applied to one log half by the blade and to the other log half by the sledge head which acts as a fulcrum when the sledge handle is pulled through an arc. One or more wedges are used for the initial split and are preferably left in for the log splitting operation by the log splitting sledge. After the initial split, the log splitting sledge in inserted vertically into the split. The log splitting sledge handle is rocked back and forth, each movement opening the partially split log a little further. Each time the log is split a little further the one or more wedges left in the split slide down into the log a little further preventing the split from closing. After the split, the log is still held together by wood slivers which join the split portion of the log. A cutting blade attached to and/or an integral part of the bottom face of the sledgehammer head is used to cut the slivers. As a matter of perspective, the handle extends from the top face of the sledgehammer head. The slivers are cut by the cutting blade by moving the sledgehammer up and down into the split part of the log with the handle held vertically. The sledge acts as a vertical axe.

Preferably the blade is attached only to or is integral with one lengthwise side of the bottom face of the sledgehammer head, though two blades, each attached to a lengthwise side of the bottom face of the sledgehammer head is within the scope of the present invention. It is also preferable that a face of the blade facing downward from a face of the head be set at a small angle to the handle; so that the handle can pass through a large arc, effectively forcing the log open throughout the entire arc, before it hits a side of the log being split during the log splitting operation. The face of the blade which is common to a side face of the head forms an angle with respect to the handle of from 5 to 25 degrees. An angle of from about 10 to 15 degrees is preferred. Any angle which allows the projection to continuously increase the width of the split as the handle move through an arc is advantageous, though it is preferable that the angle be large enough to allow the handle to move through the maximum arc allowed by the split sides of the log and therefore exert more log splitting movement. The face of the head that is common to the face of the blade is the lengthwise side face of head which is attached to the blade.

The angle of the side face of the head with respect to the handle is created by either forming a bend in the handle near where it enters the head or by forming a non 90 degree angle opening through the head for the handle. It is preferred that the opening for the handle extend through the center of the head, an equal distance from both lengthwise sides. With this configuration, the metal on both sides of the handle is of equal thickness and strength. The handle can extend through the center of the head regardless of the configuration of the head. An advantage of running the handle through the head at a non 90 degree angle to a side face, is that the metal thickness can be increased in the area of maximum stress.

The present invention is directed to a log splitting sledgehammer having a projection extending downwardly from the head in a direction primarily away from the handle which extends upwardly. The end of the projection forms the end of a lever arm which exerts force against an inner surface of a split log when the head of the sledge is inserted into a partially split log and rotated through an arc. Motion of the handle in an arc having a center of rotation through the head exerts log splitting force on the inner surfaces of the partially split log where the projection and the sledge head contact the inner surfaces.

Preferably, the projection extends downward from the head parimarily in a direction opposed to the upward direction in which thehandle extends, and secondarily to a minor extent to the same side of the head face as the handle. It is also preferred that the projection be tapered, becoming narrower in a direction away from the handle. The tapered projection in its preferred form is a blade having a cutting edge. In a preferred form, a face of the projectionis integral with and forms a smooth flat surface with a lengthwise side face of the head, though the invention is operative if the face of the projection and the face of the head meet at an angle other than 180 degrees.

As outlined above, the blade also performs the function of a short end of a lever arm utilizing the sledge head as a fulcrum. After the sledge head is inserted into the partially split log, motion of the sledge handle in an arc around the head forces the partially split log apart. In order to force the two halves of the partially split log apart a sufficient distance to completely split the log, it is preferred that the projection extend from one eighth to two inches from the head, though this projection is not necessary if a lengthwise side face meets the bottom face of the head at an angle of less than 80 degrees. In order to provide sufficient surface area and horizontal stability, it is preferred that the projection blade or cutting edge have a length of from one to four inches. To provide sufficient strength, it is preferred that the projection have a width, in the area in which the projection is attached to the head, of fron one eighth inch to one inch. It is more preferred that the projection have a width, in the area in which the projection is attached to the head, of from one fourth inch to one half inch. In order to increase the arc of rotation and thereby improve log splitting efficiency, it is preferred that the handle be at an angle of from 5 to 25 degrees and more preferably at an angle of from 10 to 15 degrees with a lengthwise face of the head that is common to a face of the projection. This angle can be achieved by forming the handle opening through the sledge head at a non 90 degree angle or by forming a bend in the handle near where the handle enters the head.

In order to most effectively split a log, it is preferred that the head of the sledge be heavy in order to strike a strong blow to a wedge in the initial splitting of the log. It is also preferred that the head be narrow so as to fit into the initial split to cut slivers holding the two split halves together and to pry the partially split log apart. In order to achieve both a high mass and a narrow head, it is preferred that the lengthwise vertical face of the head which is integral with the projection is designed to have a larger area than any face of the head which is adjacent to the face integral with the projection. More preferably the vertical face integral with the projection has an area from 10% to 50% larger than any adjacent face. In calculating the area of the head face integral with the projection, the total area of the head face and the projection face integral with the head face is considered the area of the head face.

In order to accentuate the projection at the bottom of the log splitting sledge and to accentuate the sharpness of the blade at the bottom of the sledgehammer it is preferred that a long side face of the head meet a bottom face of the head at an angle of less than 90 degrees. In a more preferable embodiment, the side face meets the bottom face at an angle of from 45 degrees to 80 degrees. To achieve the goal of high mass, good leverage and a sharp cutting blade, it is also preferably that the side face have a greater surface area than the bottom face.

It is preferred that the sledgehammer have a head weighing at least four pounds and a handle at least two feet long. It is also preferred that the sledge have a head weighing less than 25 pounds. More preferably, the head has a weight of from 6 to 18 pounds. The weights and handle lengths of sledges used to drive wedges in logs are known in the art and the same weights and handle lengths are applicable in the practice of the present invention.

Top, bottom and side refer to components as they exist when the handle of the sledge is extending straight upward from the sledge head.

DETAILED DESCRIPTION

Figure 1:
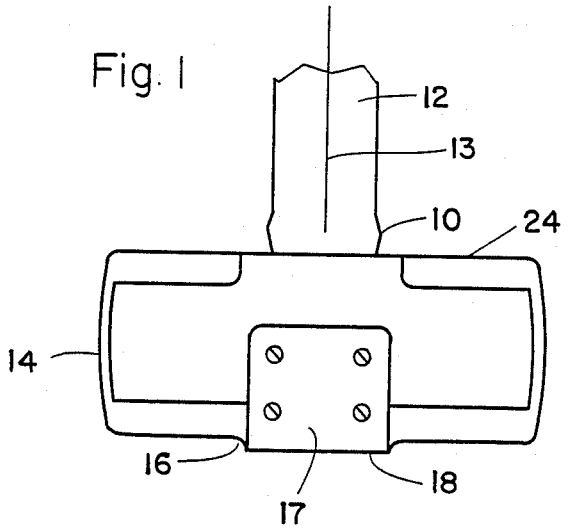
FIG. 1 is a side view of the log splitting sledge of the present invention.
Figure 2:
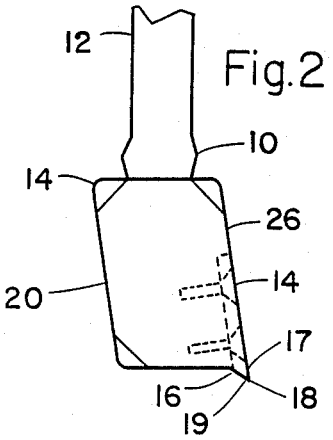
FIG. 2 is an end view of the log splitting sledge of the present invention.
Figure 3:
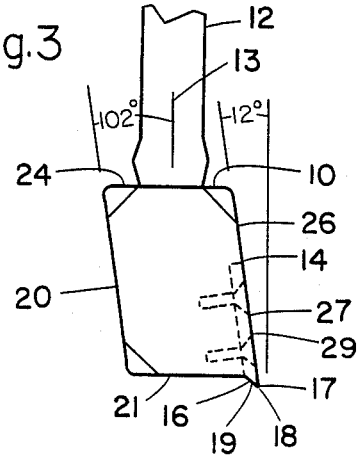
FIG. 3 is an end view of the log splitting sledge of the present invention showing the angular relation of the projection and head side to the lengthwise geometrical center line of the handle.

The first embodiment of the log splitting sledge is designated generally at 10 and the first embodiment includes a conventional handle 12 having a lengthwise geometrical center line 13 and a modified head 14. One major modification of the head is projection 16 which forms long side 17 of cutting blade 18 as shown in FIGS. 1, 2 and 3. The cutting blade 18 is two inches long and the long sides 17 and 19 of the blade meet at the cutting blade 18 at an angle of 68 degrees. The head 14 is six and one forth inches long.

Figure 4:
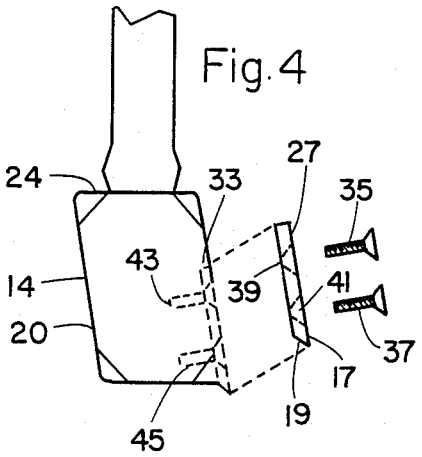
FIG. 4 is an exploded view of FIG. 2.

As is shown in FIG. 4, side face 20 has a greater height (two and one forth inches) that the width of top face 24 (one and seven eights inches). This high narrow cross section allows the head 14 to enter deeper into a partial split in a log than if the same mass of head had a square cross section or if the sides of the cross sectional parallelogram were equal. Side face 20 meets top face 24 at an angle of 78 degrees. The same angular relationship exists between bottom face 21 and side face 26. This angular relationship attenuates the sharpness and the projection of cutting edge or cutting blade 18.

As is shown in FIG. 3, the handle 12 of the log splitting sledge 10 of FIGS. 1 and 2 enters an opening (not shown) of the top face 24 of head 14. As is shown in FIG. 3, this entry of the handle 12 sets the lengthwise center line of the handle 13 and the handle 12 at an angle of 12 degrees to the common side face 26 of projection 16 and head 14 and insert plate 27. This angular position allows the handle to be pulled through a larger arc when forcing the partially split log 28 apart and cooperates with the high narrow configuration of the head 14 to force the sides of the partially split log further apart thus further improving the log splitting operation. Thus common face 26 includes long face 17 of projection 16, face 29 of insert 27 and side face 31 of head 14, all of which faces form a smooth surface face 26.

FIG. 4 shows an exploded view of the insert plate 27 and head 14. Insert plate 27 fits into recess 33 (shown in dotted lines) in head 14. Plate 27 is held in place by screws 35 and 37 which pass through openings 39 and 41 in plate 27 and are screwed into threaded openings 43 and 45 in head 14.

Figure 5:
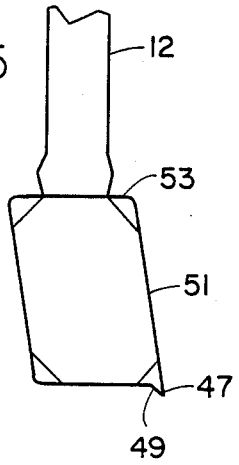
FIG. 5 illustrates and embodiment of the invention wherein the projection is integral with the head.

As is shown in FIG. 5 long face 47 of projection 49 is integral with side face 51 of head 53. FIG. 5 illustrates an embodiment in which the projection 49 has been forged in one piece with the head 53.

Figure 6:
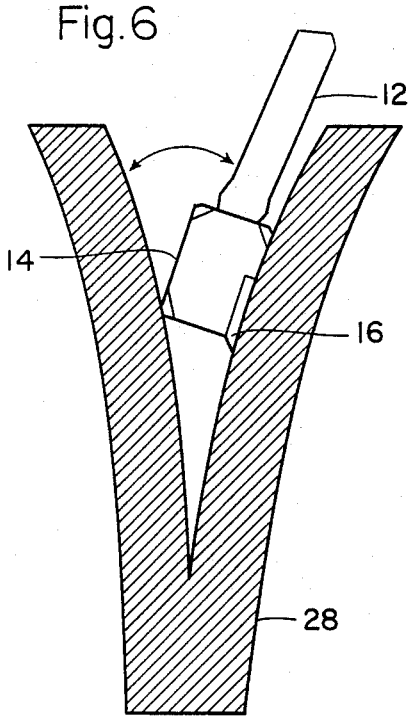
FIG. 6 illustrates the sledge of FIG. 1 inserted into a partially split log.
Figure 7:
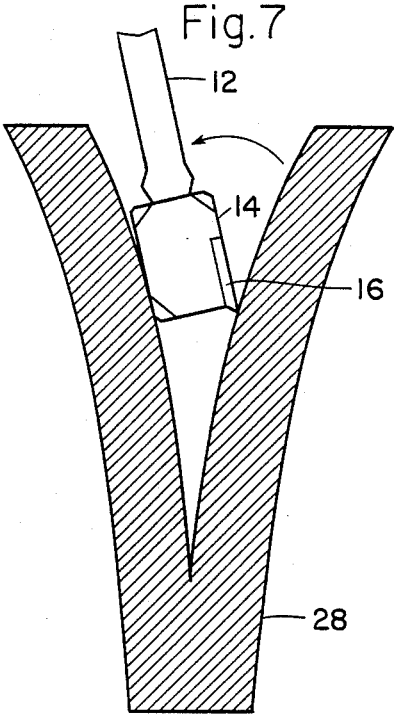
FIG. 7 illustrates the beginning of the motion used to further the split.
Figure 8:
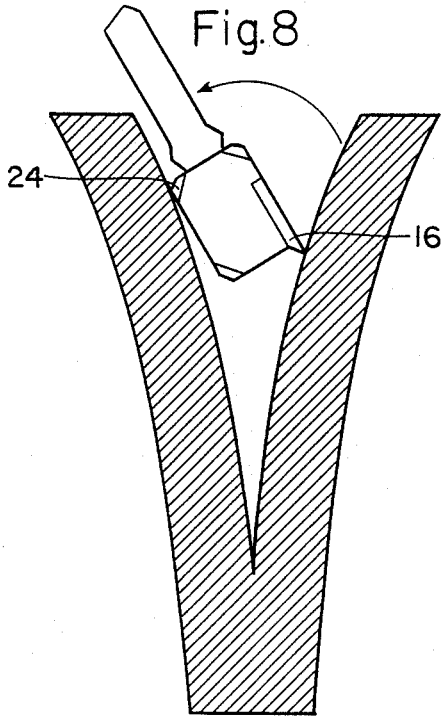
FIG. 8 illustrates the continuation of the motion used widen the split even wider than that shown in FIG. 7.

FIGS. 6, 7 and 8 illustrate the log splitting operation of the present invention. Head 14 is inserted into a partially split log 28 and the arrow shows the direction of travel of the handle 12 in splitting the log apart.

Figure 9:
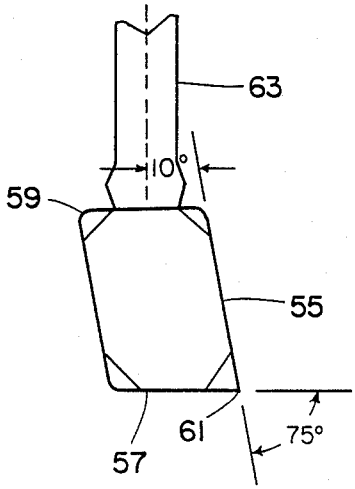
FIG. 9 is an end view of a log splitting sledge which has a side face of the head meet a bottom face of the head at an angle of 75 degrees.

In splitting a log having a thirty inch diameter, the split is started using two wedges spaced a sufficient distance apart. The log splitting sledge can be inserted between the wedges, and then the procedure illustrated in FIGS. 7, 8 and 9 is followed with the wedges left in. As the split widens and lengthens, the wedges slide down into the split preventing the split from returning to a more closed position as the handle of the sledge is moved from one opposite extreme to another.

A non preferred modification of the log splitting sledge is shown in FIG. 9. There side face 55 meets bottom face 57 of head 59 at an angle of 75 degrees to form cutting edge 61. The angular meeting of the two faces forms a sufficient projection, that no additionl projection is required. Projection is defined to include any extension formed by the angular meeting of a side wall of the head and a bottom wall of the head at an angle of 85 degrees or less (as compared to a 90 degree angle). Handle 63 enters head 59 at an angle of 10 degrees relative to a plane formed by face 55, handle 63 extending toward the plane.

Figure 10:
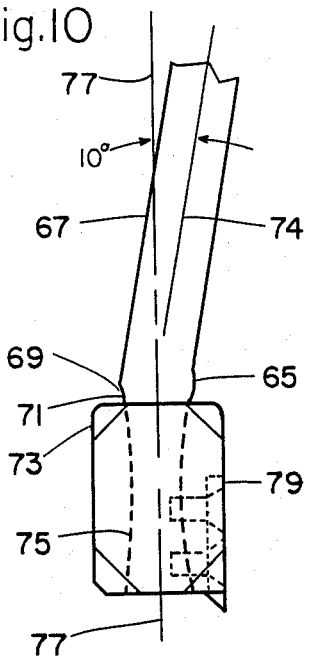
FIG. 10 is an end view, shown partially in section, of a log splitting sledge of the present invention showing the opening for the handle extending through the center of the sledge head and the handle bent at an angle of 10 degrees with respect to a vertical line through the sledge head.
Figure 11:
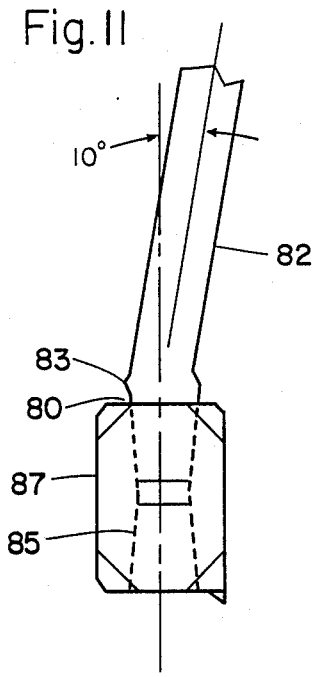
FIG. 11 is an end view, like that of FIG. 10 except that the projection which forms the blade is integral with the head instead of being attached.
Figure 12:
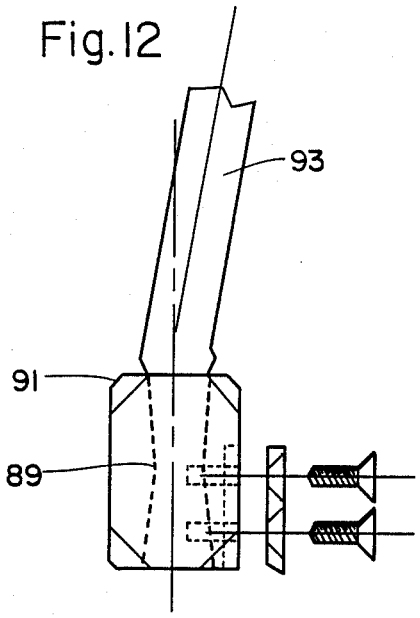
FIG. 12 is an exploded view of FIG. 10 showing the blade, screws and recessed face of the sledge head.

A second embodiment of the present invention is shown in FIGS. 10, 11 and 12. The second embodiment differs from the first embodiment in that the handle is set at a side angle of from 5 to 25 degrees from a line extending through the center of the handle opening through the sledge head. Like the first embodiment, this side angle allows the handle to be moved through a large arc, increasing the size of the split in the log throughout the entire arc.

A second embodiment of the log splitting sledge is designated generally at 65 and includes a handle 67. Handle 67 has a bend 69 near where handle 67 enters opening 71 in head 73. The upper part of handle 67 a lengthwise geometrical center line 74. The portion 75 of handle 65 which extends through opening 71 of head 73 has an axial center line 77. The two axial center lines meet at an angle of 10 degrees. The angle formed between a plane extending from the lengthwise side face 79 of head 73 and axial center line 74 also has a value of 10 degrees. Opening 71 extends through the center of head 73.

The log splitting sledge 80 of FIG. 11 corresponds to the log splitting sledge of FIG. 5 with the following exceptions. Handle 82 has a 10 degree bend at 83. Opening 85 extends through the center of head 87, whereas in FIG. 5 the handle extends at an angle of about 10 degrees to a side face, through the head. Also the cross sectional configuration of head 80 of FIG. 11 is rectangular whereas the cross sectional configuration of the head of FIG. 3 is that of a non-right angled parallelogram.

FIG. 12 is an exploded view of FIG. 10 and corresponds to FIG. 4 with the same obvious differences pointed out for FIG. 11. Again the handle opening 89 extends through the center of head 91. Handle 93 is made of steam bent wood. The bending of wood using steam and a press is known in the art and will not be described in detail here. Glass fiber reinforced plastic sledge handles are also well known in the art. The handles of the present invention could also be made of glass fiber reinforced plastic which has been bent to the configuration shown in FIGS. 10, 11 and 12.

All of the sledges shown have two foot handles, and 8 pound heads (estimated). The projections extend one sixteenth inch from plane extending from the bottom face of the heads. The projections have a width of about three fourth inches at their base and a length along the lengthwise direction of the head, of about two inches. These dimensions are not critical, and it is well within the skill of the art, using the teachings of the present disclosure to design log splitting sledges with cutting edges to force logs apart by leverage action.

The log splitting sledge heads are made in the same manner as conventional sledge heads, though of a different design. After forging or casting, the integral blades are shapened.

I claim:

1. A log splitting sledge having a handle and a head, the head having a top face, a bottom face, two side faces, and two striking faces, the length of the faces being greater than the width of the faces, wherein the improvement comprises a continuous projection integral with or attached to only one of the side faces extending downward from the bottom face, the projection forming a continuous cutting blade and a lever end for positioning at an inner surface of a partially split lot whereby motion of the handle in an arc about the head will exert a log splitting force on inner surfaces of the partially split log.

2. The improvement of claim 1 wherein the projection has two lengthwise faces and the lengthwise faces of the projection meet to form an angle of less than 90 degrees.

3. The improvement of claim 2 wherein the faces of the projection meet at an angle of less than 85 degrees to form a cutting edge of the blade.

4. The improvement of claim 3 wherein the faces of the projection meet at an angle of less than 75 degrees to form the cutting edge of the blade.

5. The improvement of claim 1 wherein the projection extends from one sixteenth of an inch to two inches from the bottom face of the head.

6. The improvement of claim 1 wherein the projection has a length of from one to four inches.

7. The improvement of claim 1 wherein the projection has a width, in the area in which the projection is attached to the head, of from one eighth inch to one inch.

8. The improvement of claim 1 wherein the projection has a width, in the area in which the projection is attached to the head, of from one fourth inch to one half inch.

9. The sledge of claim 1 having an opening through the head for the wherein the opening through the head for the handle is spaced an equal distance from the lengthwise sides of the head.

10. The improvement of claim 1 wherien the handle is at an angle or from 10 degrees to 15 degrees to a lengthwise face of the head from which face the projection extends.

11. The improvement of claim 1 wherein the projection is integral with a plate, which plate is attached to and forms at least a part of a face of the head.

12. The improvement of claim 1 wherein the face of the head which is integral with the projection has a larger area than any adjacent face of the head.

13. A sledge hammer having a handle and a head, the head having a top face, a bottom face, two side faces, and two striking faces, wherein the improvement comprises a continuous projection integral with or attached to only one of the side faces the projection extending downward from the bottom face, the projection forming a continuous cutting blade, and wherein the handle is at an angle of from 5 degrees to 25 degrees to the one of the side faces from which one of the side faces the projection extends.

14. The sledge hammer of claim 9 having an opening through the head for the handle wherein the handle is bent to form the angle and the opening through the head for the handle is spaced an equal distance from the lengthwise sides of the head.

15. The sledge hammer of claim 13 wherein the handle is bent at an angle of from 5 degrees to 25 degrees to the one of the side faces from which face the projection extends.

16. A log splitting sledge hammer having a handle and a head, the head having a top face, a bottom face, two side faces, and two striking faces, the length of the faces being greater than the width of the faces, wherein the improvement comprises a single cutting edge formed by one of the side faces of the head meeting the bottom face of the head at an angle of less than 90 degrees.

17. The improvement of claim 16 wherein the one of the side faces of the head meets the bottom face of the head at an angle of from 45 to 80 degrees.

18. The improvement of claim 16 wherein the one of the side faces has a greater surface area than the bottom face.

* * * * *